US006827018B1

(12) United States Patent
Hartmann et al.

(10) Patent No.: US 6,827,018 B1
(45) Date of Patent: Dec. 7, 2004

(54) DEVICE AND METHOD FOR DRIVING A PRINTING MACHINE WITH MULTIPLE UNCOUPLED MOTORS

(75) Inventors: Klaus Hartmann, Schriesheim (DE); Bernhard Wagensommer, Gaiberg (DE); Michael Krueger, Edingen-Neckarhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 665 days.

(21) Appl. No.: 09/569,477

(22) Filed: May 12, 2000

Related U.S. Application Data

(62) Division of application No. 09/159,114, filed on Sep. 23, 1998, now Pat. No. 6,095,043.

(30) Foreign Application Priority Data

Sep. 26, 1997 (DE) ..... 197 42 461

(51) Int. Cl.[7] ..... B41F 5/16

(52) U.S. Cl. ..... 101/485; 101/486; 101/248; 101/137; 101/177; 101/183

(58) Field of Search ..... 101/485, 486, 101/142, 177, 183, 217, 232, 248

(56) References Cited

U.S. PATENT DOCUMENTS

| | | | | |
|---|---|---|---|---|
| 3,452,261 A | | 6/1969 | Tagliasacchi | |
| 4,458,893 A | | 7/1984 | Ruh | |
| 5,163,368 A | * | 11/1992 | Pensavecchia et al. | 101/136 |
| 5,377,589 A | * | 1/1995 | Kruger et al. | 101/248 |
| 5,383,392 A | | 1/1995 | Kowalewski et al. | |
| 5,398,603 A | * | 3/1995 | Hartmann et al. | 101/183 |
| 5,406,884 A | * | 4/1995 | Okuda et al. | 101/183 |
| 5,477,780 A | * | 12/1995 | Keller | 101/137 |
| 5,479,856 A | * | 1/1996 | Wirz | 101/177 |
| 5,481,971 A | | 1/1996 | Grützmacher et al. | |
| 5,615,609 A | * | 4/1997 | Hill et al. | 101/183 |
| 5,660,108 A | * | 8/1997 | Pensavecchia | 101/137 |
| 5,826,505 A | * | 10/1998 | Volz et al. | 101/183 |

FOREIGN PATENT DOCUMENTS

| | | |
|---|---|---|
| DE | 1563 591 | 8/1970 |
| DE | 31 38 540 | 4/1983 |
| DE | 41 37 979 | 5/1993 |
| EP | 0 615 941 | 9/1994 |

* cited by examiner

*Primary Examiner*—Eugene H. Eickholt
(74) *Attorney, Agent, or Firm*—Kenyon & Kenyon

(57) ABSTRACT

A device and method for synchronizing at least two printing-unit groups (2, 3) which represent a sheet-fed printing machine (1). Between the two printing-unit groups (2, 3) there is provided a transfer unit (10) being operable by means of a separately controllable drive (12). The present invention is used in sheet-fed printing machines assembled in serial arrangement.

2 Claims, 4 Drawing Sheets

DEVICE AND METHOD FOR DRIVING A PRINTING MACHINE WITH MULTIPLE UNCOUPLED MOTORS

This application is a divisional application of U.S. Ser. No. 09/159,114, filed Sep. 23, 1998 now U.S. Pat. No. 6,095,043.

FIELD OF THE INVENTION

The present invention relates to a device and a method for driving printing machines using multiple motors.

RELATED TECHNOLOGY

German Patent Application No. 15 63 591 discloses a device in which multiple motors induce a predetermined torque into a gear train or a drive shaft connecting the various printing units. The gear train enables the synchronization of the various printing units. Due to a surplus of torque, the flanks of the gear teeth are in continuous engagement with one another in one direction so as to ensure good print quality. However, it is disadvantageous in this device that an elastic deformation of the gear wheels causes a noticeable impairment of the print quality, as application of the exact required torques cannot be ensured due to the continuously varying load torque.

It is generally known to divide the printing units into separate sections which, by means of single drives, can be driven in such a manner that only slight elastic deformation of the gear wheels takes place within the printing unit sections. The individual printing unit sections are synchronized to one another in a manner that the exact transfer of a paper sheet is ensured. This device has the disadvantage that the individual printing unit sections have very large masses which receive different additional load torque during one rotation. Consequently, a very complicated regulation is required in order to achieve the print quality known from machines with separate drives. An alternative design is disclosed in the German Patent Application No. 41 37 979 A1, wherein the actual control is limited to an angularly synchronous transfer of the printed sheet. This is to say, that regulation takes place only within a certain angular range about the point of transfer, and that outside of this angular range only the rotational speed is kept constant. This makes the timing conditions for the regulation easier, but the masses remain at an unchanged high level.

SUMMARY OF THE INVENTION

It is an object of the present invention to provide a device and a method, whereby the disadvantages of the prior art are minimized.

The present invention provides a device for the synchronization of at least two printing-unit groups (2, 3) forming a sheet-fed printing machine (1), each of the printing-unit groups (2, 3) being driven by at least one separate drive motor (7, 9) and gear train, characterized in that between the printing-unit groups (2, 3) there is provided at least one transfer unit (10) with a separate variable-speed drive motor (12).

The present invention also provides a method for the synchronous transfer of printed sheets through a transfer unit (10) arranged between two printing-unit groups (2, 3) driven using a respective separate drive, characterized in that through the if transfer unit (10) arranged between two printing-unit groups phase synchronism is first established with respect to the printing-unit group (2) arranged in front of said transfer unit and then with respect to the printing-unit group (3) arranged behind it.

The present invention has the advantage that owing to a separately driven transfer unit the printing machine is uncoupled and at the same time remains easy to be regulated.

The printing-unit groups in front of and behind the separation are respectively connected with one another using a conventional gear-wheel train and are each provided with one drive. Through this separation the interconnected printing units show a favorably low vibration tendency, i.e. the natural frequency of the printing-unit groups still is high enough so that there is no inducement of significant vibration, even at maximal production speed. The regulation of these drives does not need to be synchronized with high precision in order to achieve an in-phase paper transfer, as a phase displacement can be compensated through the transfer unit. Thus, no quick regulation of the drive of the printing units in front of and behind the transfer unit is necessary, so that vibrations caused by regulation are avoided and the printing machine produces good printing results. The phase displacement occurring in the divided printing units is compensated by regulating the transfer unit. This means that the paper sheet is received in phase at the transfer unit from the preceding printing-unit group, the phase position is then corrected during the rotary movement for the transfer to the succeeding printing-unit group, where the paper sheet is received in phase again. The quick regulation in the transfer unit is made possible because the transfer unit has little mass and no mechanical load is exerted on the printing-unit a groups in front of and behind the transfer unit. Moreover, motors possessing favorable regulating characteristics due to a low load torque can be used for this purpose. Drives which can be arranged directly on the shaft of the transfer unit are especially suitable therefor.

The transfer unit is realized, for example, in that a transfer cylinder serves as a transfer unit. From the state of the art it is known to design the transfer unit as a single-revolution cylinder, i.e. the rolling off motion (sheet plus gap) of the impression cylinder and of the transfer cylinder is identical. Furthermore is it known to design the transfer cylinder as a so called storage drum which operates at one half or one third of a revolution, thus, having a circumference which is double and three times the circumference of the impression cylinder. At any rate, the circumference of the transfer cylinder and the circumference of the impression cylinder are in an integral relationship.

However, such integral relationship is not absolutely necessary as mechanical coupling can be eliminated. For example, a transfer cylinder with a circumference of two-and-one-half times the circumference of the impression cylinder has the advantage that the range of the angle of rotation in which a phase correction can be performed is a larger one. It also is contemplated to use the gap between two sheets caused by the cylinder channel for phase correction.

For example, the transfer cylinder, after receiving a sheet, rotates with the same circumferential speed as all cylinders arranged in front thereof. Thereby it is ensured that the sheet does not experience any relative movement with respect to its transport medium, so that there is no danger of smudging. If the sheet is located outside of the printing nip, that is, outside of the feed surface of the transferring printing unit, the sheet can be accelerated or slowed down, until an exact alignment of the phase of the transfer unit with the phase of the succeeding printing-unit groups has taken place. The rotary movement of the transfer unit is therefore not continuous but depends on diameter and modulated phase correction.

It is advantageous that the moment of take-over and the moment of transfer are not identical, but are such that in the interim a respective phase correction is possible, having effect first on the printing-unit group located behind the transfer unit and then on the printing-unit group located in front of said transfer unit.

The present invention has the additional advantage that register corrections can be carried out by setting the phase relationship. A controlled phase displacement at the take-over and/or transfer of the sheet can be used so that the paper-sheet rim gripped by the grippers becomes wider or narrower, thereby enabling the setting of the register. The same is true when the device according to the present invention is used for sheet-tuning. This means that the transfer unit takes the place of the present perfecting drum. It is known that in the sheet-turning process the trailing edge of the sheet is grasped and that for switching from front-side printing to perfecting and for different formats various settings or adjustments have to be carried out; these can take place through a simple program conversion per push-button. Thereby, the stand-still times for preparing the machine for a change in orders are considerably reduced.

Concerns that in the case of failure of one controller the synchronous state of the machine components may be lost and collisions in the gripper region and consequently machine damages may result can be eliminated by the device and method according to the present invention. When a transfer cylinder having flattened sides as required by the design is used as a transfer unit, then said transfer cylinder can be placed into a position where the printing unit groups in front or in the back thereof cannot cause any damage. In the case of a power failure the power supply can be ensured in that kinetic energy is converted by the operation of a generator. The transfer cylinder can also be brought into this safety position when the machine must be stopped for carrying out washing or other working cycles. This may reduce the makeready time.

The arrangement of the device according to the present invention is can be applied whenever printing-unit groups or individual printing units are to be connected to one another through a transfer unit.

In an alternative embodiment of the present invention the mechanical coupling of the printing-unit groups is through a gear train and a separate drive is assigned to a transfer unit. The transfer unit, in this case too, can be a single rotating cylinder. When a sheet is taken over from the printing-unit group arranged in front, the drive brings about an exact engagement between the flanks of the gear teeth in that direction. Principally, this is also a method of phase correction of the transfer unit relative to the respective printing-unit groups, however within smaller angular ranges. When the sheet is transferred from the transfer unit to the printing-unit groups arranged in the back, a respective exact engagement between the flanks of the gear teeth is established in that direction. This is accomplished by suitable sensors for measuring the angular difference or by suitable torque-measuring devices. The measurement of the angular difference can be carried out, for example, using two incremental encoders which are respectively disposed directly at the units participating in the sheet transfer. A defined and controlled angular difference within the limits of the elastic deformation of the gear wheels is in proportional relationship with the torque applied.

The divided printing-unit groups are regulated through their controller in a manner that they function as separate machines without having to give consideration as to whether the torque is rectified when a sheet is transferred. It is the task of the transfer unit arranged between two printing-unit groups to effect an engagement between the flanks of the gear teeth in the right direction. This means that in the case of a sheet take-over from the printing-unit group arranged in front to the transfer unit the torque must be directed towards the transfer unit. If the situation makes it necessary, this can be accomplished by applying a braking torque to the transfer unit through its drive.

In the case of a sheet transfer from the transfer unit to the printing-unit group arranged in back thereof, a torque is directed towards that printing-unit group, this torque being applied through the drive of the transfer unit.

The designation "printing-unit group" is not limited to a group of printing units but also includes a combination of printing unit and feeder or printing unit and delivery. The same is true for varnishing units or similar aggregates, in which sheets are treated by an in-line method.

BRIEF DESCRIPTION OF THE DRAWINGS

The present invention will be explained in more detail hereinafter in view of the accompanying drawings, in which.

DETAILED DESCRIPTION

Figure 1:
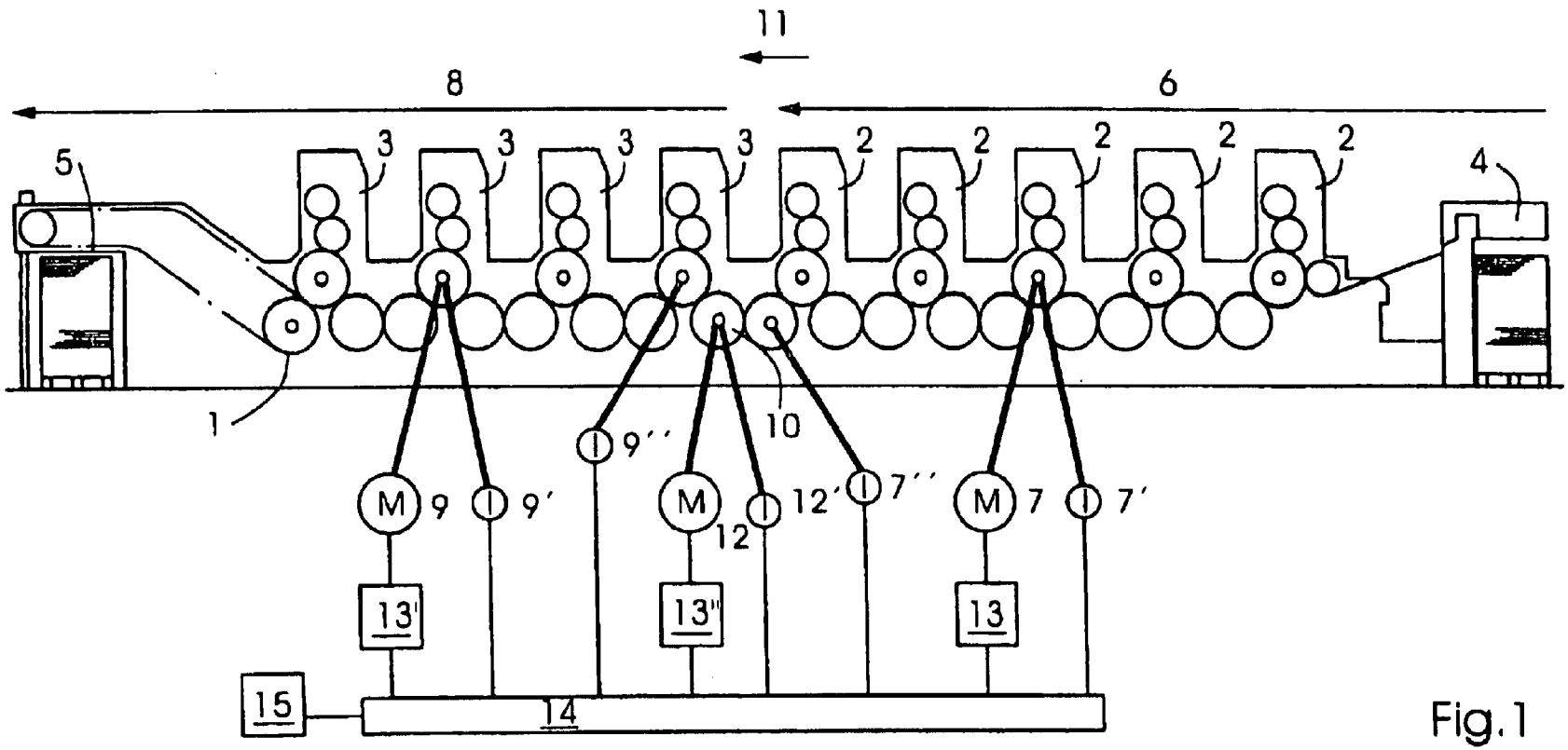
FIG. 1 is a schematic arrangement of the device according to the present invention.

FIG. 1 shows a printing machine 1 with multiple printing units 2 and 3 in serial arrangement. A sheet to be printed is fed by the feeder 4 and transported through the printing units 2 and 3 to the delivery 5. The printing units 2 and the feeder 4 are connected with one another through a gear train, which is indicated by an arrow 6. The drive of the printing-unit group 2 together with the feeder 4 takes place through a motor 7. The printing units 3 and the delivery 5 are equally connected through a gear train, which is indicated by an arrow 8. The drive of the printing-unit group 3 together with the delivery 5 takes place through a motor 9. Between the two printing-unit groups 2 and 3 there is a transfer unit in the form of a transfer unit 10 which is mechanically uncoupled from the gear t of both printing-unit groups 2 and 3. The arrow 11 is indicative of the function of the transfer unit 10 between the printing-unit groups 2 and 3. The transfer unit 10, in the exemplary embodiment, is illustrated by a transfer cylinder, but it can be any other sheet-transporting arrangement. The transfer unit 10 is driven by a motor 12, the angular position of which being measured by an incremental encoder 12'. The angular position of the two other motors 7, 9 is measured by respective incremental encoders 7', 9'. All motors 7, 9, 12 are provided with the required power through respective power sections 13, 13', 13".

The three motors 7, 9, 12 are regulated through a control device 14. It is the task of the control device 14 to regulate the motors 7 and 9 in accordance with a predetermined setpoint speed in such a manner that the value of a predetermined angular difference between the two printing-unit groups 2 and 3 is not exceeded. The maximal difference depends on the dynamic range of the drive system of the transfer unit 10. It is a further task of the control device 14 to bring the transfer unit 10, at the moment of sheet take-over, in exact phase alignment with the last sheet-carrying cylinder or drum of the printing-unit group 2 arranged in front of said transfer unit and to bring the transfer unit 10, at the moment of sheet transfer, in exact phase alignment with the first sheet-carrying cylinder or drum of the printing-unit group 3 arranged in back of said transfer unit.

An input device 15 arranged in front of the control device 14 transmits to the control device 14 the various setpoint values, such as for speed, for a certain angular position, for acceleration and braking functions and the like.

It may be advantageous for the device according to the invention to dispose additional incremental encoders 7" and 9" at the respective sheet-carrying cylinder or drum immediately adjoining the transfer unit 10. Alternatively, it is feasible to assign the incremental encoders 7' and 9' to the cylinders adjoining the transfer unit 10, instead of to the cylinder to which a torque is applied.

Figure 2:
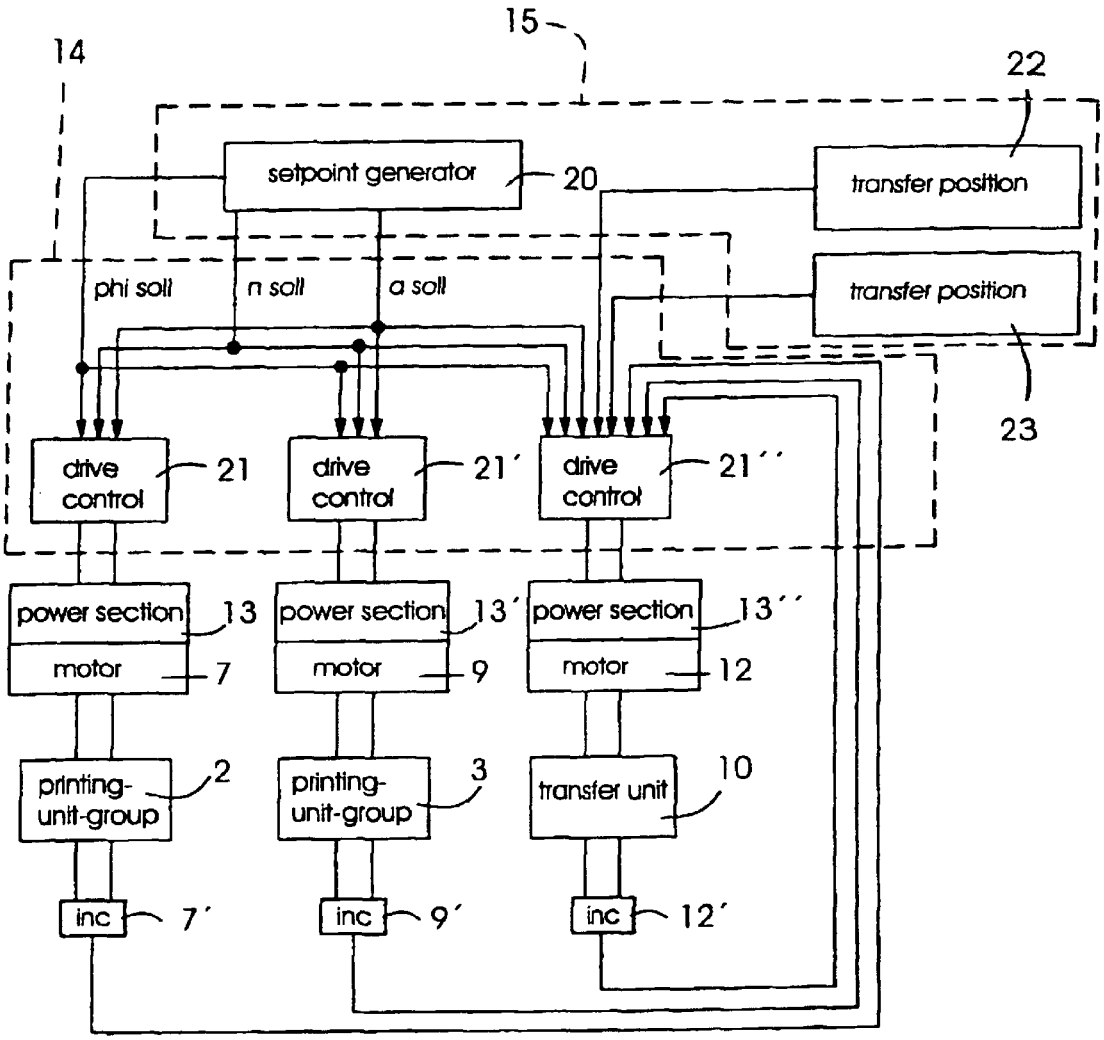
FIG. 2 is a block diagram of the drive control.
Figure 3:
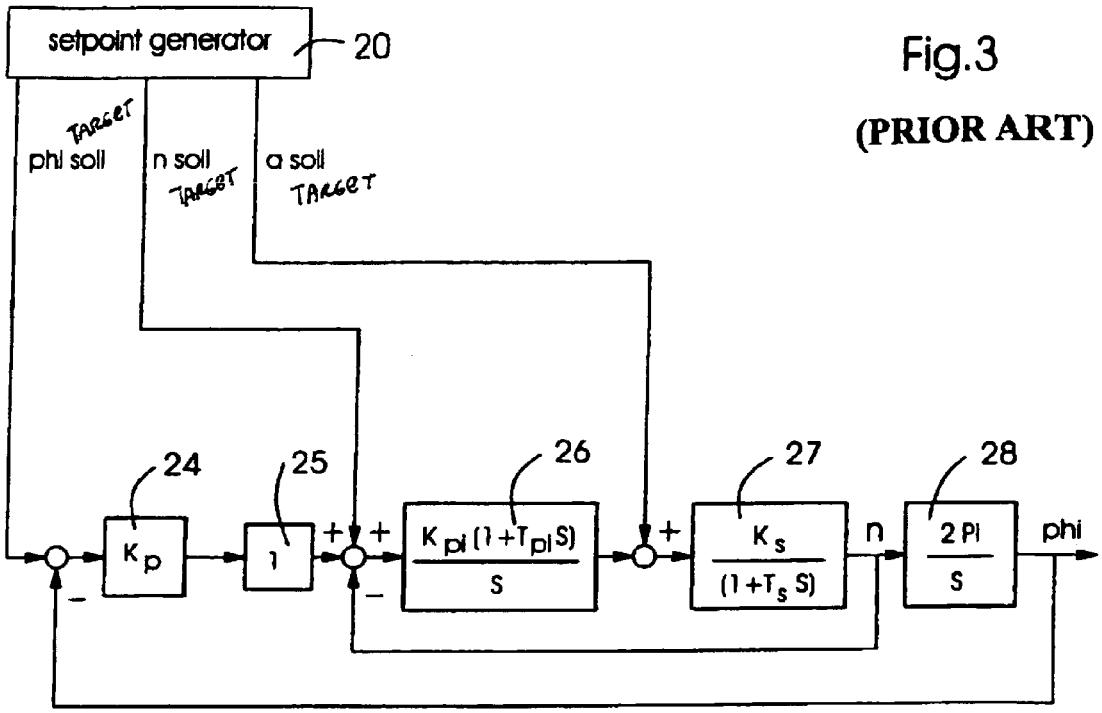
Fig.3 (PRIOR ART)
FIG. 3 is a structural view of the drive control.

FIG. 2 shows a block diagram of the drive control. A setpoint generator 20 outputs a predetermined angle setpoint value phi soil, a speed setpoint value n soil, and an acceleration setpoint value a soil. These values are transmitted to the respective drive controls 21, 21' and 21". The drive control 21 is assigned to the power section 13 for the motor 7 which drives the printing-unit group 2. The drive control 21' is assigned to the power section 13' for the motor 9 which drives the printing-unit group 3. The drive control 21" is assigned to the power section 13" for the motor 12 which drives the transfer unit 10. Both printing-unit groups 2 and 3 as well as the transfer unit 10 are operated on the basis of the predetermined setpoint values phi soll, n soll and a soll transmitted to the respective drive controls 21, 21', 21". The incremental encoders 7', 9', 12' respectively assigned to the printing-unit groups 2, 3 and the transfer unit 10 transmit their setpoint values in correspondence with the respective angular positions of said printing-unit groups and said transfer unit to the drive control 21" which additionally receives information about the constructionally given transfer position of the paper sheet. Alternatively is it possible to detect the position of the sheet edge or the position of the gripper or the like using a sensor and to use the detected value as an actual value for the transfer control. It is also feasible to use a combination of position sensor and incremental encoder. From the transfer position 22 it is determined in which angular position the transfer of a sheet from the printing-unit group 2 to the transfer unit 10 is taking place. From the transfer position 23 it is determined in which angular position a transfer of a sheet from the transfer unit 10 to the printing-unit group 3 is taking place. The transfer positions 22, 23 are given by the mechanical construction, but in the perfecting mode of operation they can be determined by the sheet format FIG. 3 is a structural illustration of the drive control as known in prior art. The setpoint generator 20 outputs the setpoint values phi soll, n soll and a soll to the drive control as guide values. The control values are composed of the actual speed value n and the actual angle value phi, which are based on the setpoint values of the incremental encoders 7', 9', 12'. The controller and controlled system includes components as follows: A proportional-action controller 24, 25 which is used as position-controller; Kp represents the proportional-action gain factor.

A proportional-action-integral-action controller 26 as speed controller with the gain factor Kpi.

The controlled system 27, whereby Ks represents the amplification of the controlled system and Ts represents the time constant of the controlled system.

A calculator unit 28, in which on the basis of the actual speed value n the actual angle value phi is calculated; S represents the Laplace-operator.

Figure 4:
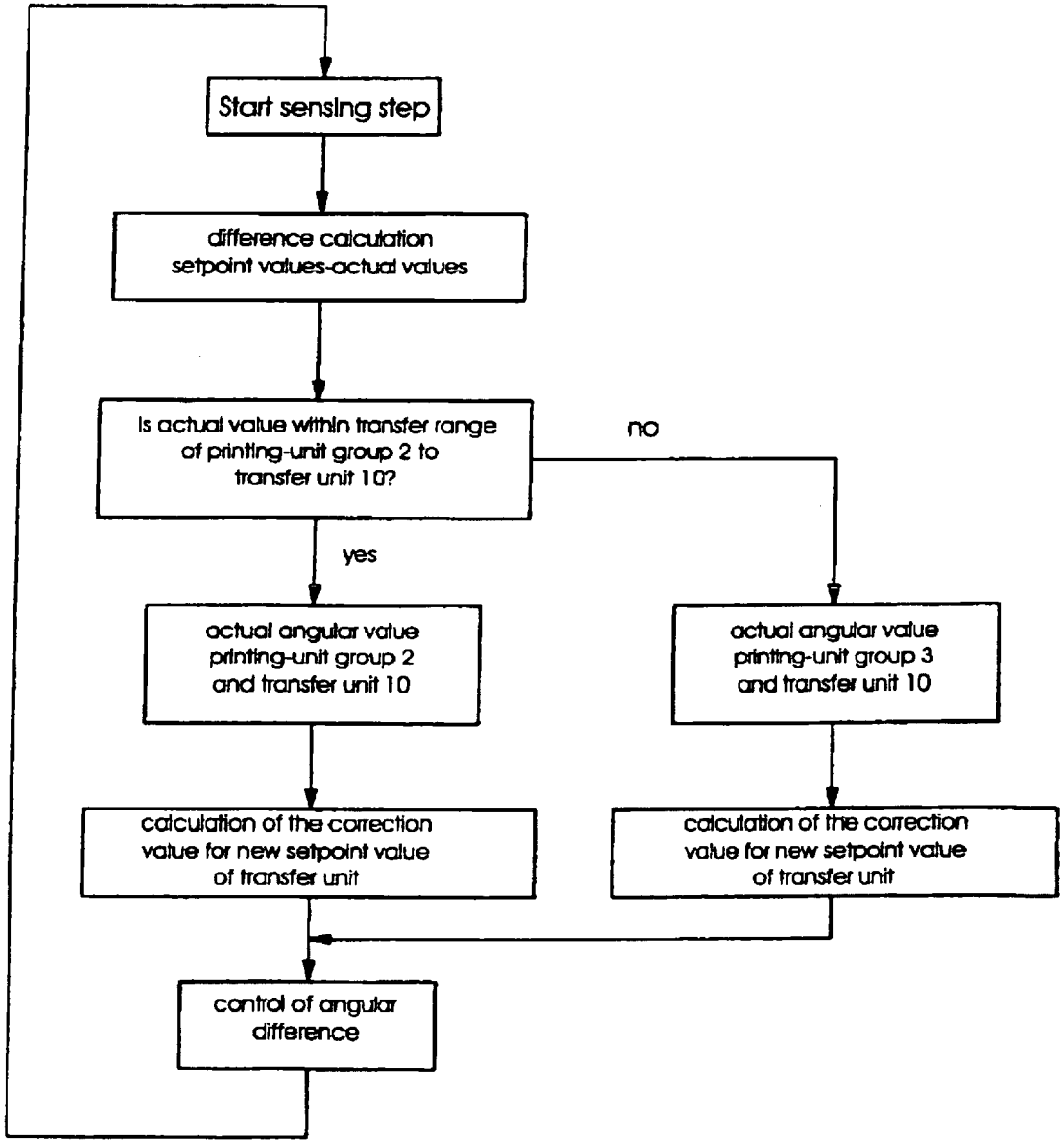
FIG. 4 is a flow diagram of the control strategy.

FIG. 4 is a flow diagram which illustrates the coordination of the transfer unit 10 with the printing-unit groups 2 and 3. In one area a regulation of the position of the transfer unit 10 with respect to the position of the printing-unit group 2 takes place, and in a second area a regulation of the position of the transfer unit 10 with respect to the position of the printing-unit group 3 takes place. Thereby, an angle setpoint value phi soll, a speed setpoint value n soll and an acceleration setpoint value a soll are respectively calculated for the controller of the transfer unit, and in a further step a regulation of the angular difference is achieved.

Figure 5:
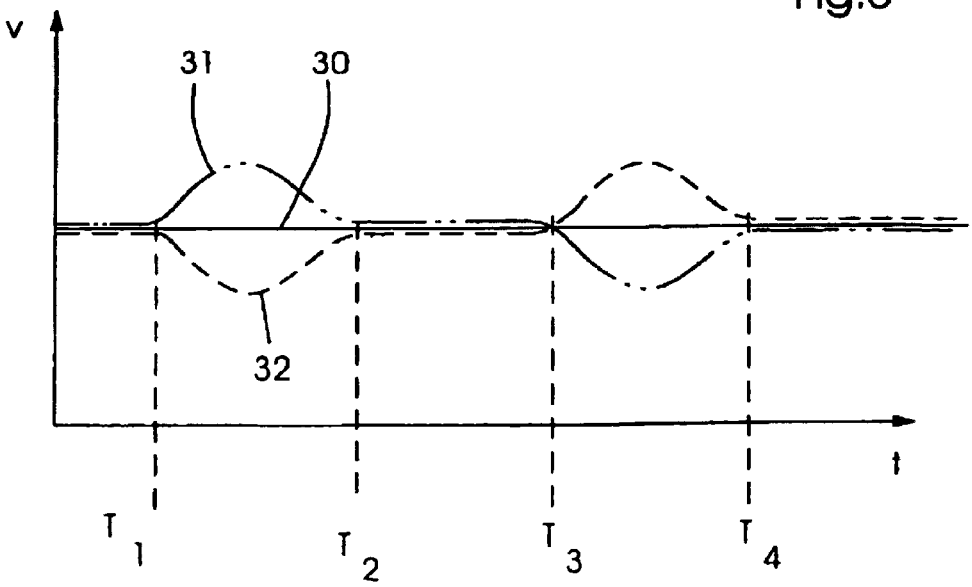
FIG. 5 is a speed pattern of the transfer unit.

FIG. 5 is a diagram which shows the course of speed of the transfer unit 10 over the time period of transport of a sheet, i.e. within this time period the sheet is received by the printing-unit group 2, transported and then transferred to printing-unit group 3. Three different speed regimes are illustrated by the curves 30, 31, 32.

The curve 30 shows a constant speed indicating that between the printing-unit groups 2 and 3 there is no phase displacement. In this case it is the task of the transfer unit 10 to maintain its speed exactly at the speed value of both printing-unit groups 2, 3 in order to ensure an angularly synchronous transfer of the sheet.

The curve 31, like the curve 30, shows a constant course of speed up to the point of time $T_1$. At the point of time $T_1$ the transported sheet is still in contact with the drum or cylinder arranged in front of the transfer unit 10. If at this point of time the transfer unit 10 were accelerated or braked, smudging of the sheet would be the result.

Therefore, the transfer unit 10 is moving within this critical angular range at the same circumferential speed as the last drum or cylinder of the printing-unit group 2. From the point of time T, on, the whole sheet is situated on the transfer unit 10, so that the phase correction can be performed. Curve 31 illustrates an acceleration from $T_1$ on, i e. the transfer unit 10 moves so as to gain an existing angular difference with respect to the printing-unit group 3 arranged in back thereof. From the point of time $T_2$ on angular synchronism with respect to the printing-unit group 3 is established and the transfer unit 10 moves at a constant speed, i e. at the same circumferential speed as the printing-unit group 3 arranged in back thereof. In the time period between $T_2$ and $T_3$ the transfer of the sheet from the transfer unit 10 to the printing-unit group 3 can take place. This may be accomplished, for example, using known control cams. From the point of time $T_3$ to the point of time $T_4$ braking of the transfer unit 10 takes place, which means that the transfer unit 10 moves so as to lose the angular difference which it gained in the time period between $T_1$ and $T_2$. At the point of time $T_4$ angular synchronism is established again between the transfer unit 10 and the printing-unit group 2, and an angularly synchronous take-over of a sheet from the printing-unit group 2 to the transfer unit 10 can take place. From the point of time $T_4$ on the process is repeated, whereby the amplitude of the curve, i.e. the acceleration or braking of the transfer unit 10 can have different values, depending on the amount of angular difference.

While the curve 31 illustrates the case that a positive angular difference exists between printing-unit group 2 and printing-unit group 3, i.e. that the printing-unit group 3 is leading with respect to printing-unit group 2, the curve 32 illustrates the reverse case, i.e. that the printing-unit group 2 is leading with respect to the printing-unit group 3. Therefore, between $T_1$ and $T_2$ the transfer unit 10 is braked and between $T_3$ and $T_4$ the transfer unit 10 is accelerated.

What is claimed is:

1. A method for synchronous transfer of printed sheets through a transfer unit arranged between a front printing-unit group in front of the transfer unit having an impression cylinder forming a printing nip and a rear printing-unit group behind the transfer unit having an impression cylinder forming a printing nip, the front and rear printing-unit groups being driven by at least one separate drive and the transfer unit being located outside the printing nips, the method comprising:

first establishing a first phase synchronism through the transfer unit with respect to the front printing-unit group; and then establishing a second phase synchronism with respect to the rear printing-unit group.

2. A method for synchronous transfer of printed sheets through a transfer unit arranged between a front printing-unit group in front of the transfer unit and a rear printing-unit group behind the transfer unit, the front and rear printing-unit groups being driven by at least one separate drive, the method comprising:

first establishing a first phase synchronism through the transfer unit with respect to the front printing-unit group; and then establishing a second phase synchronism with respect to the rear printing-unit group, wherein the first and second phase synchronisms are established by a defined engagement between flanks of teeth of gear wheels of the front printing-unit group and the transfer unit and between flanks of teeth of gear wheels of the rear printing-unit group and the transfer unit.

* * * * *